US007392731B2

(12) United States Patent
Nonaka

(10) Patent No.: US 7,392,731 B2
(45) Date of Patent: Jul. 1, 2008

(54) PAPER CUTTER

(75) Inventor: Tadashi Nonaka, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 235 days.

(21) Appl. No.: 11/061,193

(22) Filed: Feb. 18, 2005

(65) Prior Publication Data

US 2005/0183560 A1 Aug. 25, 2005

(30) Foreign Application Priority Data

Feb. 20, 2004 (JP) ..... 2004-044669

(51) Int. Cl.
*B26D 5/08* (2006.01)
*B26D 5/14* (2006.01)

(52) U.S. Cl. ..... 83/694; 83/614; 83/618; 83/627; 400/621; 101/227

(58) Field of Classification Search ..... 83/694, 83/614, 627, 629, 631, 636, 821, 856, 202, 83/563, 566, 616, 624, 626, 628, 697, 603, 83/602, 695, 660, 203, 618, 214; 400/621, 400/54, 593, 690; 101/227
See application file for complete search history.

(56) References Cited

U.S. PATENT DOCUMENTS 5,105,703 A * 4/1992 Kondo ..... 83/636
6,109,154 A * 8/2000 Miyatsu et al. ..... 83/627
6,152,007 A * 11/2000 Sato ..... 83/582
6,405,625 B1 * 6/2002 Nomura et al. ..... 83/618
6,508,600 B1 * 1/2003 Nonaka ..... 400/621

FOREIGN PATENT DOCUMENTS

JP 01-289697 11/1989
JP 10-296681 11/1998

OTHER PUBLICATIONS

Patent Abstracts of Japan, vol. 1999, No. 3, Mar. 1999, JP 10 315174, English Abstract.
Patent Abstracts of Japan, vol. 2003, No. 12, Dec. 2003, JP 2004 017169, English Abstract.

* cited by examiner

*Primary Examiner*—Ghassem Alie
(74) *Attorney, Agent, or Firm*—Pearne & Gordon LLP

(57) ABSTRACT

In a force cutting type paper cutter, a movable blade includes a pair of right and left edges having a V shape. These right and left edges are intersected and brought into pressure contact with a linear cutting edge of a fixed blade. The movable blade also includes a pair of right and left elastic pieces formed by a lateral slit and a division slit provided in the movable blade. These elastic pieces are held in an inclined state to the side of the fixed blade and such that the edges overlap with each other. During a cutting stroke, the elastic pieces are held a state in which the edges of the movable blade always make point contact with the edge of the fixed blade and uneven abutment is prevented.

6 Claims, 8 Drawing Sheets

PAPER CUTTER

BACKGROUND OF THE INVENTION

1. Cross-Reference to Related Applications

This application claims priority from Japanese Application No. 2004-044669, filed Feb. 20, 2004, the entire disclosure of which is hereby incorporated by reference.

2. Field of the Invention

The present invention relates to apaper cutter, for example, suitable to cut paper accumulated in roll shape to an arbitrary length in a small printer, etc.

3. Description of the Related Art

Force cutting type paper cutters in which a plate-shaped fixed blade and a movable blade are arranged to oppose across a paper transfer path wherein the movable blade is reciprocated with respect to the fixed blade, and wherein at the time of a forward movement, paper sandwiched between both the blades is cut, are known. There is a method in which the movable blade of such paper cutter is constructed so that an edge of the movable blade has a symmetrical V shape. The V shape juts from the center toward both ends in a direction of the forward fixed blade. During a cutting operation, its edge makes pressure contact with an edge of the fixed blade side while intersecting with the edge of the fixed blade side (for example, refer to JP-B-8-22517 and JP-A-10-296681). In this case, it is critically important to generate "action by a structure of scissors" in which the edges of both the blades mutually slide in a point contact state to provide good sharpness. Therefore, in order to implement such a structure, a method in which one blade is bent so as to form a convex in a direction of the other blade using a mount is proposed in JP-B-8-22517 and a method in which a blade is previously molded in a bend state is proposed in JP-A-10-296681, respectively.

SUMMARY OF THE INVENTION

In the structure in which the edge of the movable blade has a V shape and either the movable blade or the fixed blade is bent as described above, the edge of the V shaped movable blade makes point contact with the edge of the fixed blade at two points of both sides of the V shape by one point. It is desirable that contact portions of these two points make well-balanced contact with the edge of the opposite fixed blade at equal cutting pressures in order to cut the paper smoothly. However, in a force cutting type paper cutter, there are cases where a situation in which the movable blade inclines in a direction relatively lateral to the fixed blade is caused by various factors such as errors of assembly or a dimension, wobble resulting from these errors, or stress applied from the side of paper. When the movable blade inclines, a contact balance between the two points is lost. For example, a pressure contact state of the edge becomes weak at one contact point and becomes strong at the other contact point, and trouble such as defective cutting or unbalanced wear in the edge occurs.

Also, in the structure in which a blade is bent, there is a problem that at the beginning of cutting in which the edges of both ends intersect with each other, cutting pressure is weak. Also at the end of cutting in which the edges of the center intersect with each other, the edges approach a parallel with each other. Thus, defective cutting tends to occur in either case. Further, it is actually difficult to hold a bend state of the blade in circular arc shape with a uniform radius with high accuracy, and it may be difficult to obtain a state in which the edges make close contact with each other.

Therefore, an object of the invention is to provide a paper cutter in which uneven abutment of edges is mitigated and a point of contact between mutual edges can be ensured and as a result, good cutting performance can be offered.

According to an embodiment of the invention, there is provided a paper cutter of a force cutting type including: a first blade having a linear edge; and a second blade arranged opposed to the edge of the first blade, which slantingly juts from an center thereof toward an outside ends in a direction of the forward first blade so as to form a substantially V shape, wherein the second blade is configured with a pair of right and left edges, and to be reciprocally movable forward and backward with respect to the first blade by a driving method, at a time of a forward movement (cutting operation), both the edges make pressure contact while intersecting with each other so as to cut a paper between both the edges, at least one of the first blade and the second blade is provided with: a lateral slit substantially perpendicular to a reciprocating direction of the second blade; a division slit for dividing the edge of the second blade into the pair of right and left edges in communication with the lateral slit, wherein a backward side of the lateral slit with respect to the other blade is served as a base, a pair of right and left elastic pieces capable of bringing each edge of the second blade divided by the lateral slit and the division slit into pressure contact with the edge of the first blade are provided on a forward side of the lateral slit with respect to the other blade, and an inclination method for inclining each elastic piece of one blade to a side of the other blade and respectively bringing each edge of one blade into point contact with the edge of the other blade.

In the embodiment of the invention, the edges of one blade (here, it is assumed that each of the slits and the elastic pieces are provided on only one blade in order to make the invention clear. Therefore, these are not formed in the other blade, however the invention is not limited to this and includes a form in which each of the slits and the elastic pieces are formed in both of the first blade and the second blade.) are respectively formed in a forward end side (end edge opposed to the edge of the other blade) of a pair of right and left elastic pieces, and the pair of right and left edges incline to the side of the other blade along with the elastic pieces inclined by the inclination method. The side of one blade or the side of the other blade used in the invention means the opposite side in which the edges of these blades intersect and overlap. Each of the elastic pieces inclines to the side of the other blade and thereby both the edges of one blade form V shape. The second blade reciprocates to the first blade and at the time of the forward movement, each of the edges of one blade with the V shape makes pressure contact while intersecting with the edge of the other blade so that paper inserted therebetween is cut. Since movement in which each of the edges of one blade respectively inclines independently along with the elastic pieces is shown, the respective edges can independently make point contact with the edge of the other blade. As a result of this, for example, even when one blade inclines in a lateral direction and this results in a situation in which uneven abutment conventionally occurs, each of the edges of one blade inclines regardless of its inclination, to ensure point contact between the mutual edges.

As the inclination method in the invention, a base bend member for inclining each elastic piece to the side of the other blade by convexly bending the base of one blade toward the side of the other blade. The base bend member also provides a method for directly pressing the center of the base to the side of the other blade or a method for pressing both ends (right and left ends) toward a direction opposite to the side of the other blade when the center of the base is fixed or is energized to the side of the other blade. In these cases, when both ends of the base are bent in a direction opposite to the side of the other blade, the pair of right and left elastic pieces are divided by the division slit, so that the elastic pieces incline to the side of the other blade with bending stress. If there is no division slit and the elastic pieces are joined (the elastic pieces are not formed in this case), the elastic pieces also bend in a manner similar to the base but are divided by the division slit, so that the elastic pieces themselves are inclined in a flat state. Incidentally, both of the form of pressing both ends of the base in a direction opposite to the side of the other blade and the form of pressing the center of the base to the side of the other blade may be used.

As another form of the inclination method, an elastic piece pressure member for directly pressing each elastic piece of one blade to the side of the other blade can be adopted. Such a pressure member can be provided on other members such as a frame or a casing in the vicinity of the paper cutter or can be provided on one blade itself. Also, the pressure member may be any of an elastic body or a rigid body. If the pressure member is an elastic body, when the edges of one blade make pressure contact with the edge of the other blade, elastic deformation of the elastic pieces is allowed and occurrence of excessive pressure contact force can be absorbed. If the pressure member is a rigid body, angles of inclination of the edges of one blade as well as the elastic pieces can be held constant.

Another configuration includes one blade that is not deformed but instead, at least the edge of the other blade is convexly bent toward the side of one blade. In this form, as the other blade forward moves in a direction of one blade and both the edges make point contact and intersect, the elastic pieces of one blade are inclined to the side of the other blade by elastic deformation and the edges of one blade also incline accordingly. That is, as one blade approaches the other blade and intersects, the edges of one blade step on the edge of the other blade and each elastic piece subject to its stress inclines to the side of the other blade. In this form, the elastic pieces of one blade incline automatically in a cutting stroke, so that it is unnecessary to separately add a member for inclining the elastic pieces, and the edge of the other blade bent and formed is configured as the inclination method.

In the invention, from the viewpoint of improving rigidity of the elastic pieces, a form of providing reinforcement method having such a function in the elastic pieces is included. A method for improving rigidity of the elastic pieces themselves without inhibiting inclination of the elastic pieces is suitable for this reinforcement method. For example, it is contemplated that a rib or a bead is provided on an extending direction of the elastic pieces or a plate material with high rigidity is applied. By improving rigidity of the elastic pieces, deflection of the elastic pieces themselves can be suppressed and limits of difficult-to-cut thickness of paper can be increased, that is, it also copes with thicker paper and the paper can be cut.

Now, in one blade of the paper cutter of the invention, the edges are divided by the division slit and are formed in a pair of right and left. The division slit is essential in the case of forming a pair of right and left elastic pieces, however because of the division slit, during a cut, a residual portion is generated in the paper and remains joined to the subsequent paper. This creates a so-called partial cut and by tearing the cut residual portion, the paper can be cut completely. Therefore, when an auxiliary edge across a pair of right and left edges divided by said division slit is provided on the back of the division slit in one blade, the cut residual portion is also cut and a complete cut, that is, a full cut can be made. For example, the auxiliary edge can be formed in one of each of the elastic pieces of one blade. When the auxiliary edge is provided thus, a relative forward movement stroke of each blade could be set at two stages of a partial cut to the division slit and a full cut in which the cut residual portion by the division slit is also cut by the auxiliary edge.

According to embodiments of the invention, a pair of right and left elastic pieces formed in at least one of a first blade and a second blade are inclined to the side of the other blade and thereby, V-shaped edges of one blade inclined along with these elastic pieces surely make two-point contact with an edge of the other blade and therefore, uneven abutment is mitigated and good cutting performance is provided. Also, when the elastic pieces are inclined, pressure contact force of the mutual edges, that is, cutting pressure can be held constant from beginning to end of cutting, so that defective cutting is mitigated.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Embodiments of the invention will be described below with reference to the drawings.

(1) First Embodiment

Figure 1:
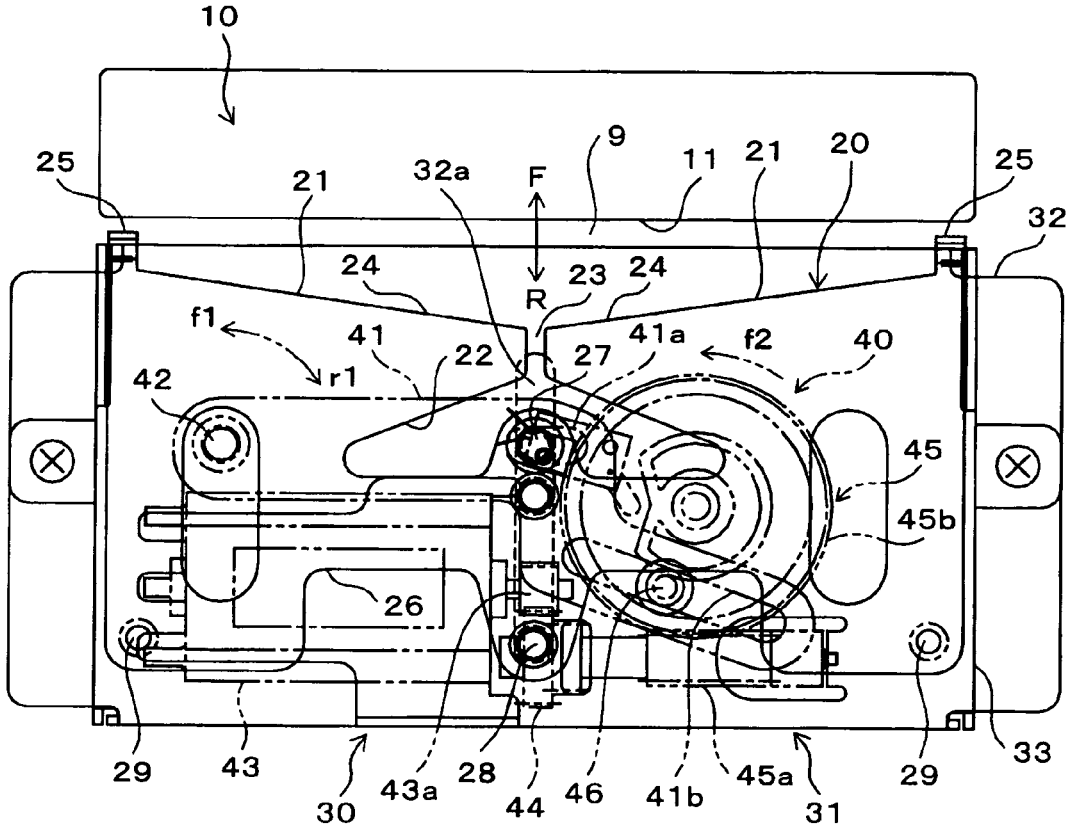
FIG. 1 is a plan view of a paper cutter according to a first embodiment of the invention.
Figure 2A:
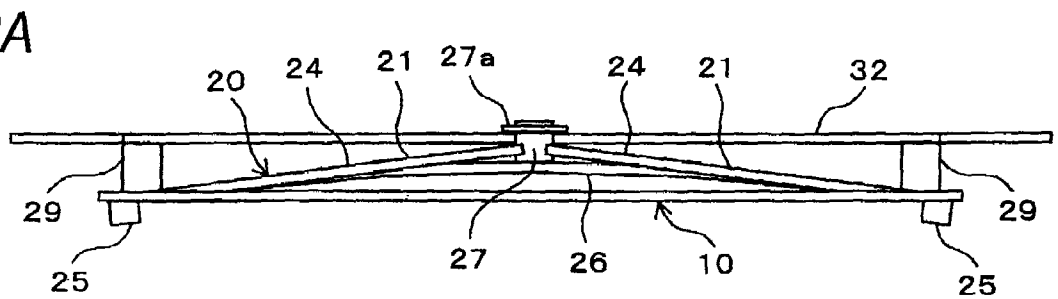
FIGS. 2A, 2B and 2C are a front view, a plan view and a side view of a state in which a cover is removed in the paper cutter of the first embodiment.
Figure 2B:
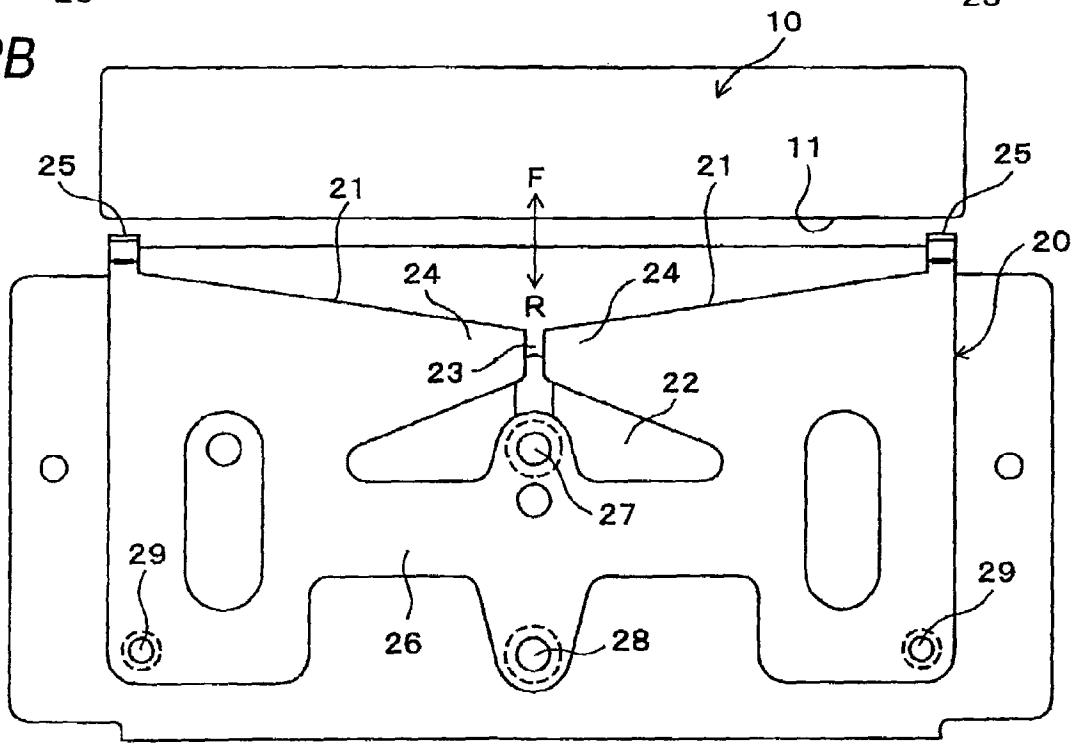
Figure 2C:
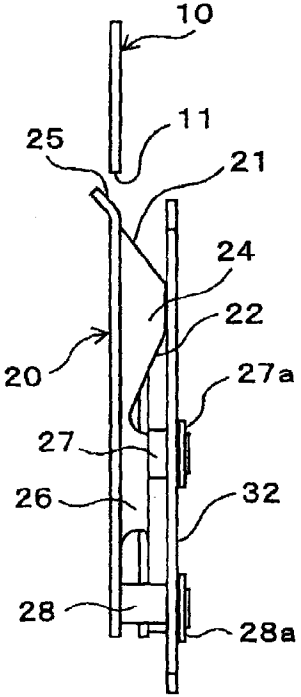

FIGS. 1 and 2

FIG. 1 is a plan view of a paper cutter of a first embodiment, and this paper cutter is configured with a fixed blade (first blade) 10 and a movable blade unit 30 having a movable blade (second blade) 20 which is arranged opposed to this fixed blade 10 and cuts paper in cooperation with the fixed blade 10. The fixed blade 10 is made of rectangular plate material, and a linear edge 11 is formed in the end edge opposed to the movable blade 20. A gap formed between this edge 11 and the movable blade unit 30 is served as a paper transfer path 9 and, for example, paper such as roll paper (not shown) is transferred to the transfer path 9 in a direction of the front and back of FIG. 1, and the paper in which the transfer is stopped is cut by the paper cutter. The edge 11 of the fixed blade 10 extends in a direction parallel to a width direction of the paper.

The movable blade unit 30 includes the movable blade 20 and a casing 31 for holding this movable blade 20, and the casing 31 includes a casing body 32 and a cover 33 fixed thereto. Only an outline in plan viewing is depicted in the cover 33 in FIG. 1, and FIG. 2B is a plan view of a state in which this cover 33 is removed. The movable blade 20 is reciprocally movably incorporated into the bottom of the casing body 32 in a forward and backward direction (direction of arrow F-R in FIG. 1).

The movable blade 20 is a blade molded by sheet metal processing using thin sheet steel etc. having elasticity as material, and has a horizontally long rectangle as a whole, and juts from the center toward both ends in a direction of the forward fixed blade 10. The edges 21 of the movable blade 20 have a symmetrical V shape formed in the front end edges. A lateral slit 22, which has a substantially triangle shape, extends in a right and left direction and is formed in the center of the movable blade 20. Further, a division slit 23 is formed from a vertex of the front end center of this lateral slit 22 toward the front end edge. The edges 21 are divided in a right and left direction by the division slit 23. Because each of the slits 22, 23 is formed, a pair of right and left elongated trapezoidal elastic pieces 24 tapered toward a top direction of the inside are formed in the forward side of the lateral slit 22. In both ends of the forward end of the movable blade 20, inclined guide pieces 25 stepping on the fixed blade 10 are provided on a protruding condition toward the front, respectively, and each edge 21 is formed between the guide piece 25 and the division slit 23.

In the movable blade 20, a portion of the backward side of the lateral slit 22 is served as a base 26, and a pair of forward and backward guide pins 27, 28 are fixed to the center of this base 26. These guide pins 27, 28 are engaged through a guide elongated hole 32*a* extending in a forward and backward direction formed in the casing body 32 and thereby, the movable blade 20 is configured so as to move along the guide elongated hole 32*a* in the forward and backward direction.

FIG. 1 and FIG. 2B show a state in which the movable blade 20 is in a home position most retracted with respect to the fixed blade 10. In this home position, the edges 21 are held inside the casing 31 and only the guide pieces 25 project from the casing 31 to the front. Then, when the movable blade 20 is advanced, it is configured so as to stop in a partial cut position. In this partial cut position, a residual portion is left in the paper by the division slit 23 when the edges 21 of the movable blade 20 overlap while intersecting with the edge 11 of the fixed blade 10 and the division slit 23 reaches the edge 11 of the fixed blade 10. The edges 21 of the movable blade 20 are set so as to overlap with a surface (upper side in FIG. 2A) opposite to the casing body 32 in this case with respect to the edge 11 of the fixed blade 10.

As shown in FIG. 2A, slider pins (inclination method, a base bend member) 29 for projecting toward the bottom of the casing body 32 are fixed to both ends of the base 26. Flanges 27*a*, 28*a* are respectively fixed to projection ends from the casing body 32 of the guide pins 27, 28. These flanges 27*a*, 28*a* slidably engage with an outer surface of the casing body 32, and the slider pins 29 slidably abut on the bottom of the casing body 32. As a result of this, the base 26 is bent so as to form a convex shape to the bottom side of the casing body 32, that is, the side of the fixed blade 10, and further by bending the base 26 thus, each of the elastic pieces 24 inclines so that the top side of the inside thereof approaches the fixed blade 10. As each of the elastic pieces 24 inclines, the right and left edges 21 are also in an inclined state so as to form a V shape by both the edges when the movable blade 20 is viewed from the forward fixed blade 10.

Next, a driving system (driving method) 40 for reciprocating the movable blade 20 will be described with reference to FIG. 1.

In FIG. 1, numeral 41 is a link. This link 41 has a front side elongated hole 41*a* and a back side elongated hole 41*b*, and is swingably configured in a direction of arrow f1-r1 by rotatably supporting one end in the bottom of the casing body 32 by a shaft pin 42. The guide pin 27 engages through the front side elongated hole 41*a* and the link 41 swings in the direction of arrow f1-r1, thereby, the guide pin 27 moves along the guide elongated hole 32*a* in a forward and backward direction, therefore the movable blade 20 is configured so as to slide in the forward and backward direction. The link 41 is swung by combination of a motor 43, a reduction gear 44, a worm gear 45 made of a worm 45*a* and a worm wheel 45*b* set in the cover 33. That is, the reduction gear 44 is meshed with a pinion 43*a* of the motor 43 and the worm 45*a* is integrally coupled on a shaft of this reduction gear 44 and the worm wheel 45*b* is meshed with this worm 45*a*. A driving pin 46 is provided on a protruding condition in an end face of the outer circumference side of the worm wheel 45*b*, and this driving pin 46 is configured so as to engage through the back side elongated hole 41*b* of the link 41 when the cover 33 is mounted on the casing body 32.

According to the driving system 40 (including the components 41 to 46 described above), rotation of the motor 43 is transmitted to the worm gear 45 through the reduction gear 44 and in a process in which the worm wheel 45*b* rotates half in a direction of arrow f2 in FIG. 1, the link 41 swings in a direction of arrow f1 and the movable blade 20 slides in a direction of F and advances from the home position to the partial cut position. Subsequently, in the process in which the worm wheel 45*b* rotates half in the direction of arrow f2, the link 41 swings in a direction of arrow r1 and the movable blade 20 slides in a direction of R and retracts from the partial cut position to the home position.

Next, action of the paper cutter according to the first embodiment will be described.

In a state in which the movable blade 20 is in a home position, paper inserted into the paper transfer path 9 between the fixed blade 10 and the movable blade unit 30 is transferred and at a point in time when the paper stops in a predetermined cut position, the paper cutter operates by power distribution to the motor 43. Incidentally, the power distribution to the motor 43 may be performed by automatic control combined with a transfer state of paper or by hand. When the motor 43 starts rotation, the worm wheel 45*b* rotates in a direction of arrow f2 in FIG. 1 and while the worm wheel 45*b* rotates half in its direction, the link 41 swings in the direction of arrow f1 and the movable blade 20 advances in the direction of F.

When the movable blade 20 advances, first, the guide pieces 25 of both ends step on both ends of the fixed blade 10, thereby a state of overlap between the fixed blade 10 and the movable blade 20 is ensured as set. Next, the pair of right and left inclined edges 21 of the movable blade 20 make pressure contact while intersecting in a point contact state respectively with respect to the edge 11 of the fixed blade 10 and the paper sandwiched therebetween is cut. During that, angles of inclination of the edges 21 and the right and left elastic pieces 24 of the movable blade 20 become smaller as the movable blade 20 advances. When the movable blade 20 advances most and reaches a partial cut position, the division slit 23 is located on the edge 11 of the fixed blade 10 and a cut residual portion is generated in the center of a width direction of the paper by the division slit 23. Subsequently, the motor 43 rotates and thereby the link 41 swings in the direction of arrow r1 and the movable blade 20 retracts in the direction of R while each edge 21 makes pressure contact with the edge 11 of the fixed blade 10, and the movable blade 20 soon separates from the fixed blade 10 and returns to the home position and in this position, the motor 43 stops. When the edges 21 of the movable blade 20 deviate from the edge 11 of the fixed blade 10, each elastic piece 24 of the movable blade 20 elastically returns to the original inclination state. In the partial cut position described above, the division slit 23 is present in the movable blade 20, so that the cut residual portion is generated in the paper to be cut and remains joined to the subsequent paper, therefore the paper can be cut completely by tearing the cut residual portion.

In the paper cutter of the first embodiment, movement in which the right and left edges 21 of the movable blade 20 respectively incline independently along with the elastic pieces 24 is shown, so that a state in which the respective edges 21 independently make point contact with the edge 11 of the fixed blade 10 is held. As a result of this, for example, even when the whole movable blade 20 inclines in a lateral direction, each of the edges 21 of the movable blade 20 inclines regardless of its inclination, so that a state of point contact (two-point contact at the right and left edges 21) with the edge 11 of the fixed blade 10 can be ensured. Therefore, uneven abutment in which one of the right and left edges 21 makes pressure contact with the edge 11 of the fixed blade 10 stronger than the other edge 21 is mitigated. Also, pressure contact force of the movable blade 20 to the fixed blade 10, that is, cutting pressure can be held constant from beginning to end of cutting. As results of these, good cutting performance can be offered.

Incidentally, in the case of improving rigidity of the elastic piece 24 by a method for providing a rib or a bead, etc. on a surface (surface of the side which does not make pressure contact with the fixed blade 10) of the elastic piece 24 along an extending direction of the elastic piece 24, deflection of the elastic piece 24 itself can be suppressed. As a result of this, even for thicker paper, the paper can be cut smoothly. Also, the slider pins 29 are fixed to the movable blade 20, however the slider pins 29 may be fixed to the bottom of the casing body 32 as long as both ends of the base 26 can always be pressed to the opposite side of the fixed blade 10 during reciprocating movement of the movable blade 20.

Next, second to fourth embodiments will be described. Incidentally, in the drawings seen in these embodiments, the same numerals are attached to the same components as those of the first embodiment and their descriptions are omitted or simplified.

(2) Second Embodiment

Figure 3:
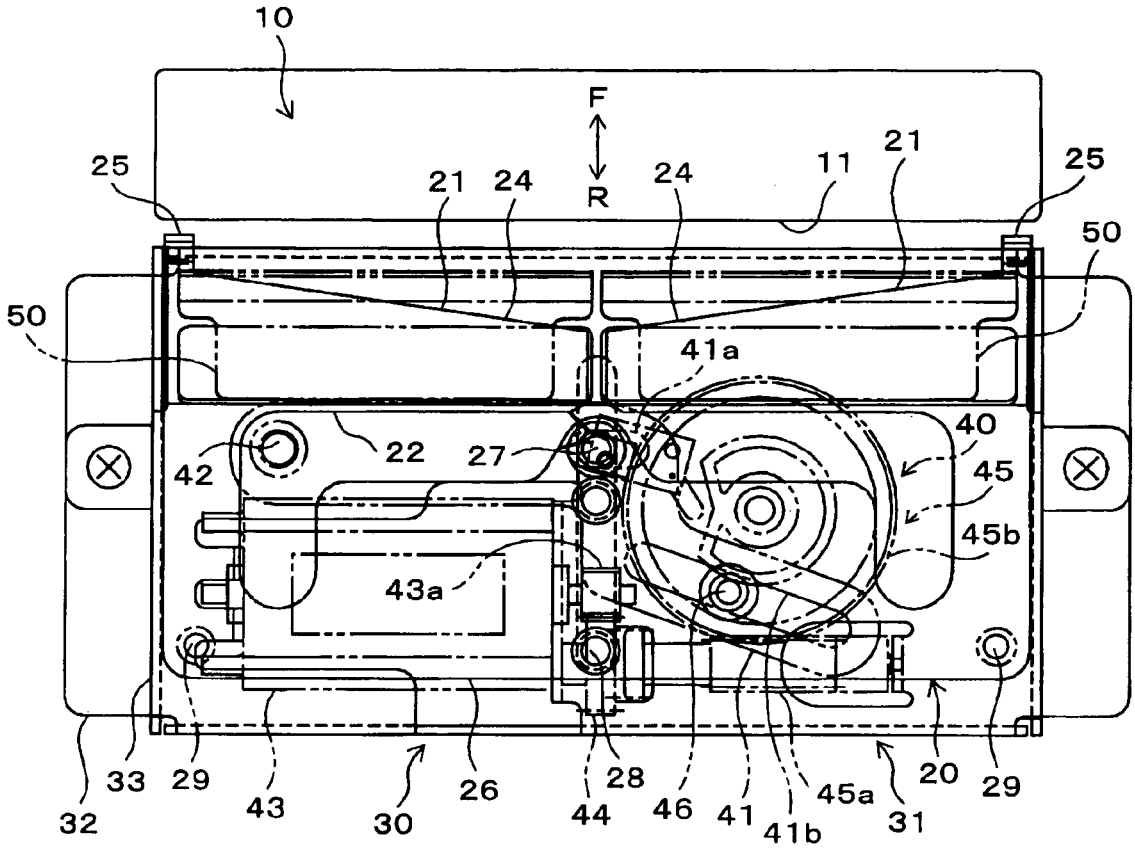
FIG. 3 is a plan view of a paper cutter according to a second embodiment of the invention.
Figure 4A:
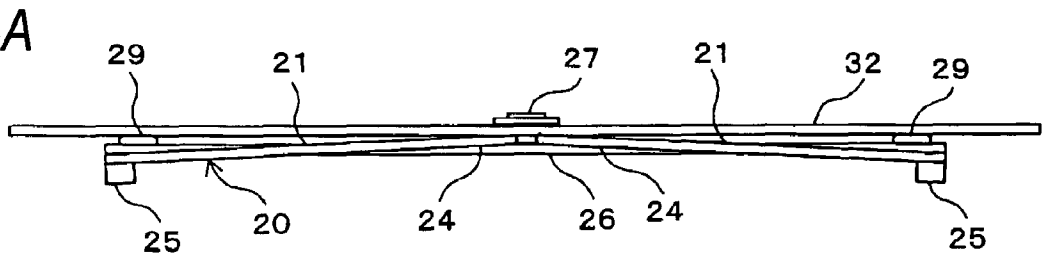
FIGS. 4A and 4B are a front view and a plan view of a state in which a cover is removed in the paper cutter of the second embodiment and FIG. 4C is a sectional view taken on line C-C of FIG. 4A in a state of having the cover.
Figure 4B:
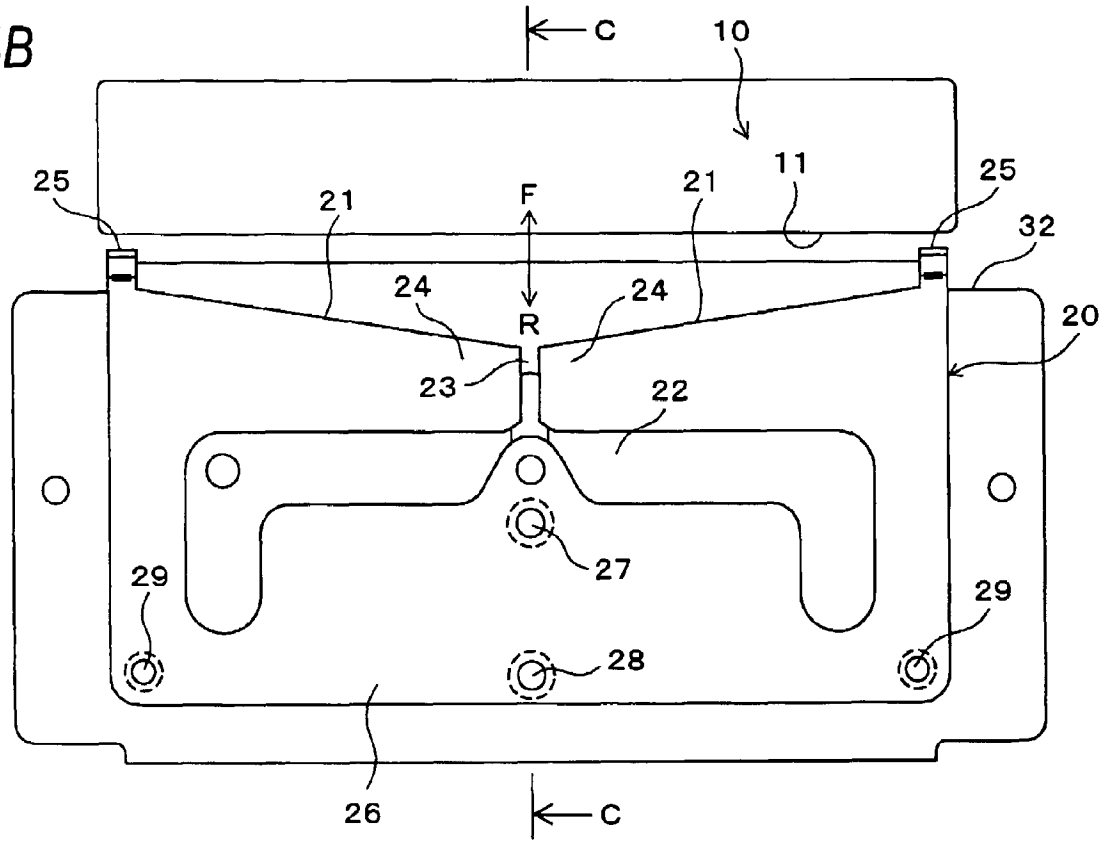
Figure 4C:
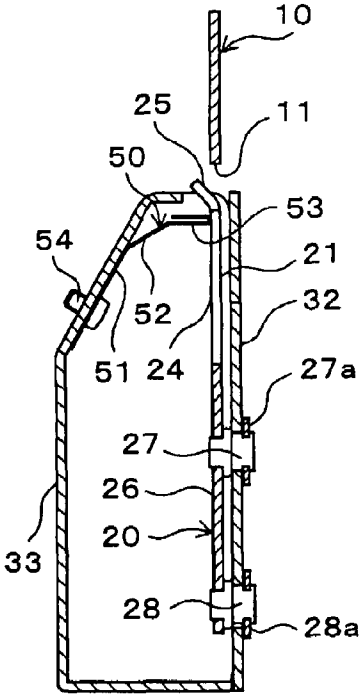
Figure 5:
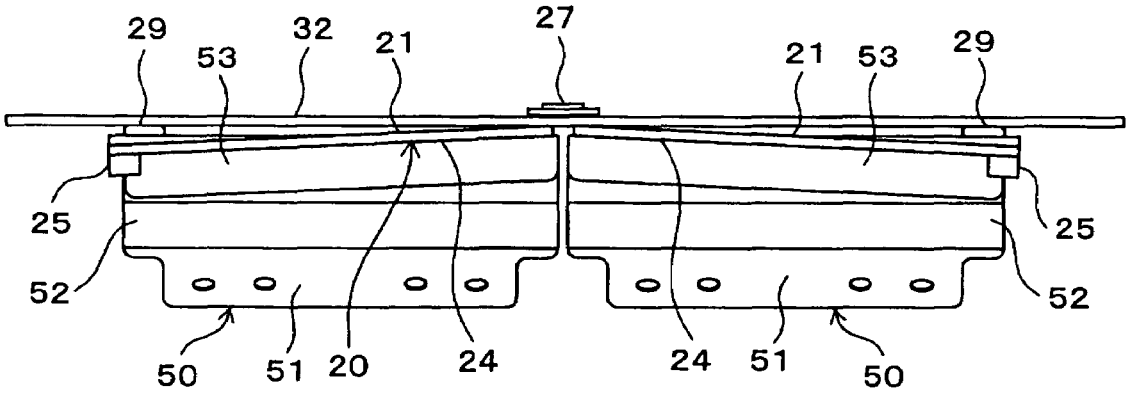
FIG. 5 is a front view showing a state in which elastic pieces of a movable blade are pressed by leaf springs fixed to the cover of the second embodiment.

FIGS. 3 to 5

As shown in FIGS. 3 and 4B, a lateral slit 22 of a movable blade 20 has a shape in which substantially L-shaped slits are connected to each other at a top portion so as to form symmetry, and a division slit 23 communicates with a center portion. Heights of slider pins 29 provided on both ends of a base 26 of the movable blade 20 are lower than those of the first embodiment, and the slider pins 29 is not a method in which by the slider pins 29, the base 26 is bent and elastic pieces 24 and edges 21 of the movable blade 20 are inclined. In the second embodiment, as shown in FIGS. 3, 4C and 5, leaf springs (inclination method, an elastic piece pressure member) 50 fixed to the cover 33 are used as a base bend member for inclining the right and left elastic pieces 24 of the movable blade 20.

The position of the leaf spring 50 corresponds with the right and left elastic pieces 24, and has a fixed part 51 coupled to the cover 33, an intermediate part 52 extending from the front end of this fixed part 51 to the side of the movable blade 20 and a folded double pressure part 53 of the top of this intermediate part 52 as shown in FIGS. 4C and 5. The fixed part 51 is fixed to an inner surface of the cover 33 by a screw 54. The leaf springs 50 are arranged over each of the elastic pieces 24 in a state in which the cover 33 is mounted on the casing body 32 and in the state, the pressure parts 53 incline so as to approach the side of the bottom of the casing body 32 (side of a fixed blade 10) from the ends of the outside toward the ends of the inside thereof, and both of the right and left pressure parts 53 incline in a V shape.

When the cover 33 is mounted on the casing body 32, as shown in FIG. 4A, the right and left elastic pieces 24 of the movable blade 20 are pressed to the side of the bottom of the casing body 32 by each of the pressure parts 53 of the leaf springs 50 and each of the elastic pieces 24 is inclined along an inclination state of each of the pressure parts 53. Incidentally, illustration of the fixed blade 10 is omitted in FIGS. 4A and 5. While the elastic piece 24 is pressed over the substantially total length by the pressure part 53, elastic deformation of the elastic piece itself is allowed by deflection of the intermediate part 52 or the pressure part 53.

In this second embodiment, the elastic pieces 24 of the movable blade 20 are inclined by the leaf springs 50 fixed to the cover 33 and with this, inclination states of the right and left edges 21 of the movable blade 20 are held. Therefore, in a manner similar to the first embodiment, in a cutting stroke, a state in which the edges 21 of the movable blade 20 make two-point contact with an edge 11 of the fixed blade 10 is ensured and uneven abutment is mitigated to provide good cutting performance.

Incidentally, in the second embodiment, the leaf springs 50 for directly pressing each of the elastic pieces 24 of the movable blade 20 have been fixed to the cover 33 of the casing 31, however the elastic piece pressure member for inclining each of the elastic pieces 24 can also be provided on the base 26 of the movable blade 20. Also, its elastic piece pressure member may be a member having elasticity as the leaf springs 50 or may be a rigid body. For the rigid body, angles of inclination of the edges 21 as well as the elastic pieces 24 can be held constant. In this case, the elastic piece pressure member can also be configured with a projection piece formed by projecting a part of the cover 33. Further, as the elastic piece pressure member, a form in which the center portions of each of the elastic pieces 24 are respectively pressed by one point may be used and in that case, each of the edges 21 is configured so as to incline the side of the bottom of the casing body 32 with slightly curved.

(3) Third Embodiment

FIG. 6

Figure 6A:
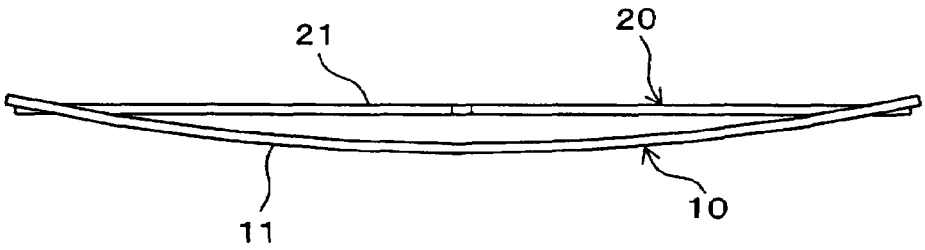
FIGS. 6A and 6B are a front view and a plan view showing a fixed blade and a movable blade of a third embodiment of the invention.
Figure 6B:
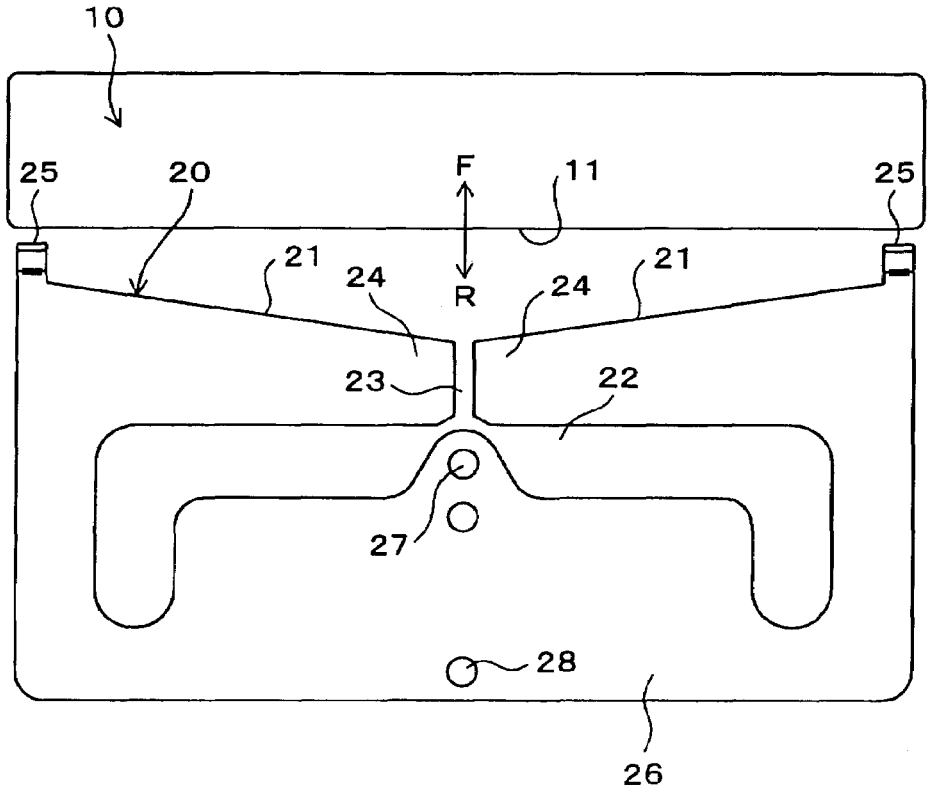

In a third embodiment, as shown in FIG. 6A, a base 26 of a movable blade 20 is not bent and elastic pieces 24 do not incline and normally, these base 26 and elastic pieces 24 are in a flat state. Then, in this case, the whole fixed blade 10 of the opposite side is bent over both ends so as to form a convex to the side of the movable blade 20. In order to bend the fixed blade 10, elastic deformation is performed by pressing the center while both ends are fixed, the fixed blade 10 being of a material having elasticity. Also, in addition, a method for molding the fixed blade in a bent state can be adopted. The movable blade 20 is reciprocated in the direction of F-R by, for example, a driving system 40 similar to that of the first embodiment.

According to this third embodiment, in a cutting stroke, as the movable blade 20 advances and right and left edges 21 make point contact with an edge 11 of the fixed blade 10 and intersect, the edges 21 of the movable blade 20 step on the edge 11 of the fixed blade 10 protrusively bent to the side of the movable blade 20 and the elastic pieces 24 of the movable blade 20 subject to its stress incline to the side of the fixed blade 10 and the edges 21 also incline accordingly. Since the edges 21 of the movable blade 20 incline in this manner, a state in which their edges 21 make point contact with the edge 11 of the fixed blade 10 is ensured, uneven abutment is mitigated and thus, good cutting performance is provided. In this third embodiment, the elastic pieces 24 follow the advance of the movable blade 20 and step on the fixed blade 10 and there by incline automatically, so that it is unnecessary to separately add a member for inclining the elastic pieces 24 and as a result of this, a reduction in the number of parts and simplification of a configuration can be achieved. Also, by bending the fixed blade 10 to the side of the movable blade 20, an angle of intersection of both the edges 11, 21 increases as compared with the case that the fixed blade 10 is flat, so that better sharpness can be obtained.

Incidentally, the form in which the fixed blade 10 is bent to the side of the movable blade 20 as described above can also be applied to the first and second embodiments. That is, it is a form in which the fixed blade 10 and the base 26 of the movable blade 20 are respectively bent so as to form convexes to the opposite side, and in this form, there is an advantage capable of more increasing an angle of intersection of the edges 11, 21.

(4) Fourth Embodiment

FIG. 7

Figure 7A:
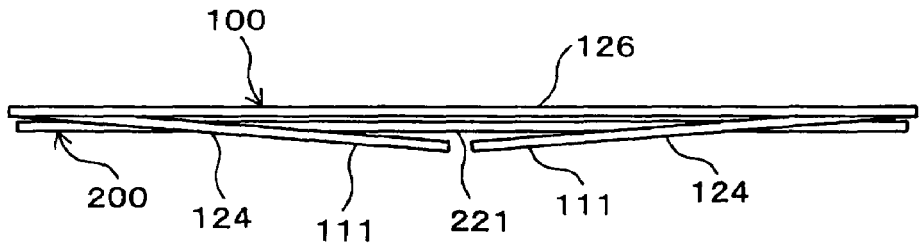
FIGS. 7A and 7B are a front view and a plan view showing a fixed blade and a movable blade of a fourth embodiment of the invention.
Figure 7B:
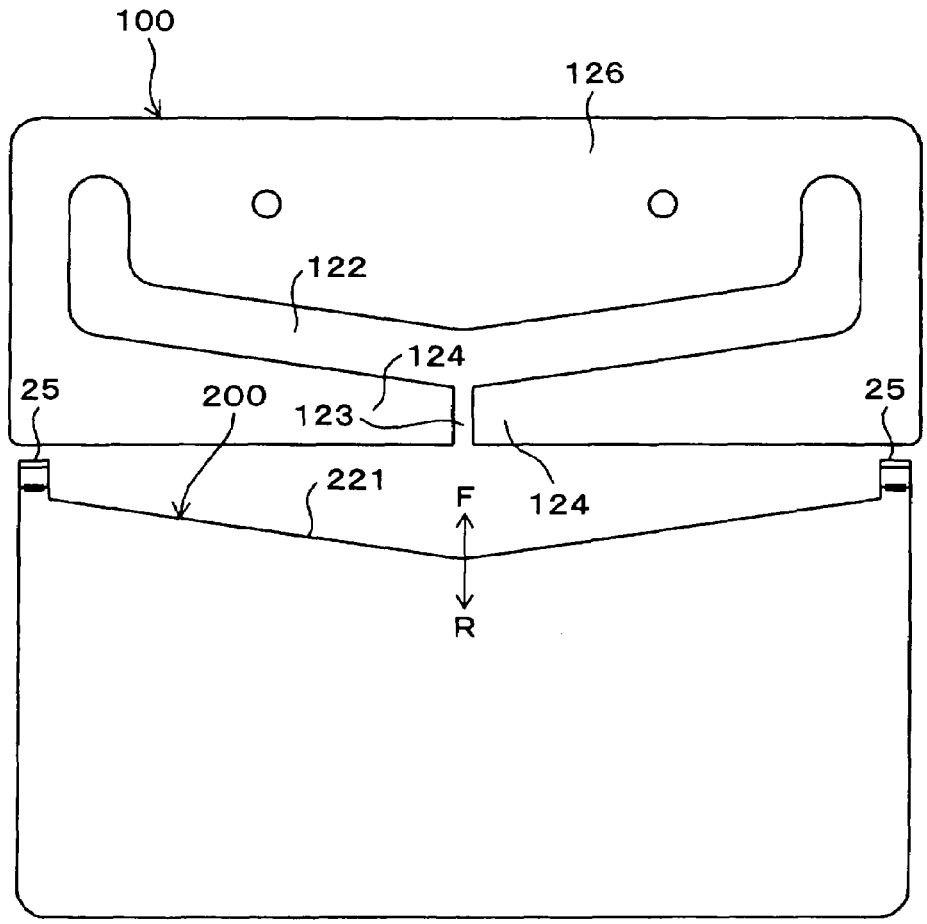

In a fourth embodiment, as shown in FIG. 7B, contrary to the first to third embodiments, a fixed blade 100 is provided with a pair of right and left elastic pieces 124 by forming a lateral slit 122 and a division slit 123 and as shown in FIG. 7A, these elastic pieces 124 are inclined to the side of a movable blade 200 and edges 111 of the fixed blade 100 incline along with the elastic pieces 124. Then, a base 126 is formed in a portion opposite to the elastic pieces 124 of the lateral slit 122. The fixed blade 100 in this case is made of material having elasticity, and a structure similar to that of the first embodiment or the second embodiment is adopted as a method for inclining each of the elastic pieces 124. That is, the fixed blade 100 is held in a casing for fixed blade (not shown) and the fixed blade 100 is incorporated into this casing for fixed blade in a bend state. Also, the movable blade 200 in this case has simply plate shape and an edge 221 is formed in a V shape and the movable blade 200 is reciprocated in the direction of F-R by, for example, a driving system 40 similar to that of the first embodiment.

In the fourth embodiment, when the movable blade 200 advances in the direction of F in a cutting stroke, the inclined right and left edges 111 of the fixed blade 100 respectively make point contact with the edge 221 of the movable blade 200 and thereby paper is cut in a manner similar to the first embodiment, and the inclined edges are only changed to the side of the fixed blade 100, and the action and effect can be obtained in a manner similar to the first to third embodiments.

Figure 8:
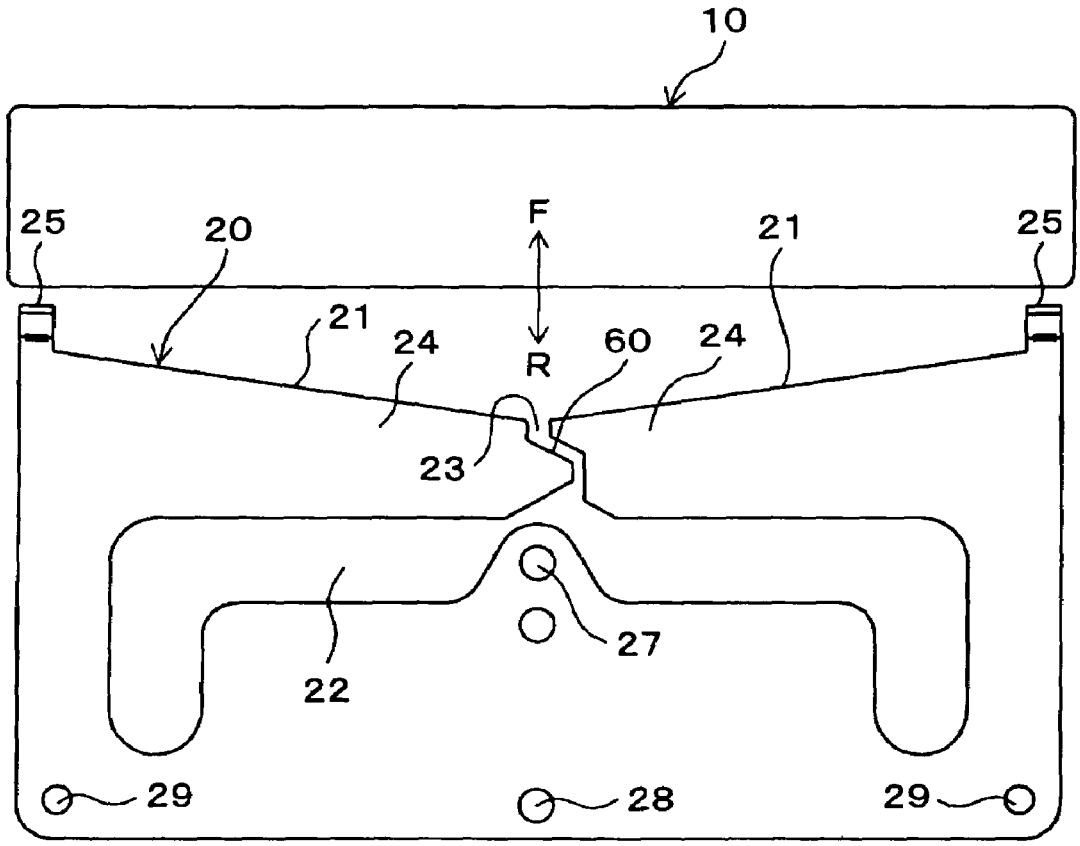
FIG. 8 is a plan view showing a fixed blade and a movable blade including an auxiliary edge.

Each of the embodiments is a type for making only a partial cut in which a cut residual portion is generated in the center of paper by the division slit 23, but can be changed to a full cut in which the cut residual portion is also cut. FIG. 8 shows a modified example in which the movable blade 20 of the second embodiment is changed to specifications capable of making a full cut too, and in this case, the division slit 23 is formed in a zigzag shape and an auxiliary edge 60 extending in a slant direction is formed in the top of one elastic piece 24 (the left elastic piece 24 in FIG. 8). This auxiliary edge 60 is formed across a pair of right and left edges 21 and when the movable blade 20 is advanced further from a partial cut position, a cut residual portion is cut by the auxiliary edge 60 and paper is fully cut. When the auxiliary edge 60 is provided thus, a forward movement stroke of the movable blade 20 could be set at two stages of a partial cut in which the division slit 23 stops at the edge of the fixed blade and a full cut in which the cut residual portion is also cut by the auxiliary edge 60. Also, it goes without saying that such an auxiliary edge can be applied to the fixed blade 100 of the fourth embodiment.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A paper cutter of a force cutting type comprising:

a first blade having a linear cutting edge; and a second blade arranged opposite to the edge of the first blade, said second blade slantingly juts from a center thereof toward an outside end in a direction of the edge of the first blade so as to form a substantially V-shaped cutting edge, wherein the second blade includes a pair of right and left edges, and the second blade is reciprocally movable forward and backward with respect to the first blade by a driving member, wherein the second blade further comprises:

a lateral slit substantially perpendicular to a reciprocating direction of the second blade;

a division slit in communication with the lateral slit, wherein a backward side of the lateral slit is served as a base, a pair of right and left elastic pieces provided on a forward side of the lateral slit, said right and left elastic pieces are configured to bring the edges of the first and second blades into pressure contact with each other, and an inclination member for inclining each elastic piece so that each edge of the second blade is brought into point contact with the edge of the first blade, and wherein, at the time of the forward movement of the second blade, both the right and left edges of the second blade make pressure contact with the first blade while inclining towards one another so as to cut a paper between both the left and right edges of the second blade and the linear cutting edge of the first blade.

2. The paper cutter according to claim 1, wherein the inclination member is configured with an elastic piece pressure member for pressing each elastic piece of the second blade to a side of the first blade.

3. The paper cutter according to claim 1, wherein an auxiliary edge is provided between the pair of right and left edges in the division slit of the second blade.

4. The paper cutter according to claim 2, wherein an auxiliary edge is provided between the pair of right and left edges in the division slit of second blade.

5. The paper cutter according to claim 3, wherein the auxiliary edge is formed in one of the elastic pieces.

6. The paper cutter according to claim 4, wherein the auxiliary edge is formed in one of the elastic pieces.

* * * * *